United States Patent [19]

Welton

[11] 4,344,635

[45] Aug. 17, 1982

[54] SHORT HAUL TOW BAR

[76] Inventor: Roy E. Welton, 3180 Browns Valley Rd., Napa, Calif. 94558

[21] Appl. No.: 205,672

[22] Filed: Nov. 10, 1980

[51] Int. Cl.[3] ..... B60P 3/10

[52] U.S. Cl. ..... 280/414.1; 280/414.2

[58] Field of Search ..... 280/414 R, 414 A, 47.13 B, 280/495, 504, 515, 414.1, 414.2; 9/343, 344

[56] References Cited

U.S. PATENT DOCUMENTS

| | | | |
|---|---|---|---|
| 3,226,738 | 1/1966 | Fox | 9/1.2 |
| 3,618,149 | 11/1971 | Christensen | 9/1.2 |
| 4,300,252 | 11/1981 | Montooth | 9/1.2 |

FOREIGN PATENT DOCUMENTS

| | | | |
|---|---|---|---|
| 589449 | 12/1959 | Canada | 280/414 A |

*Primary Examiner*—John A. Pekar

*Attorney, Agent, or Firm*—Melvin R. Stidham

[57] ABSTRACT

A short haul tow bar for a boat which is supported at one end by a pair of wheels. The tow bar is of circular tubular configuration at one end with a transverse sleeve welded across it, so that it may extend horizontally from a vehicle bumper with limited pivotal movement in a vertical plane. The bar is then curved upwardly and it is flattened at the other end to form a rectangular receptacle. A coupling bar carries a cork screw type hook which may be turned into the eye generally provided at the bow of a boat and then inserted into the receptacle to support the boat for pushing it into the water.

5 Claims, 4 Drawing Figures

SHORT HAUL TOW BAR

BACKGROUND OF THE INVENTION

Generally, when a boat is transported to a launch site by means other than a boat trailer, it is necessary to launch the boat manually.

There are available wheels which may be applied to support the stern of a small boat so that the sportsman may pick up the bow and push the boat into the water. However, even a relatively small boat can be quite cumbersome and difficult for a person to manipulate, particularly with an outboard motor mounted and fishing and other equipment aboard. Therefore, as a practical matter, it is necessary for the sportsman to take his boat, and his outboard motor and equipment, in separate trips to the water's edge. Then, when returning to shore, it is necessary to unload all of the equipment and the outboard motor at the bottom of the ramp to avoid tying it up during busy periods, and take them away from the water's edge in separate trips. In the event that one is camping for a period of several days, it is necessary to repeat this procedure, simply because of human limitation, for every trip to and from the water. To further compound the difficulty, some boat launching ramps are relatively steep making it extremely difficult to pull the boat from the water.

OBJECT OF THE INVENTION

It is an object of this invention to provide a short haul tow bar which would greatly reduce the amount of human effort required to launch a small boat.

It is a further object of this invention to provide a short haul tow bar which would eliminate the need for unloading equipment and outboard motors between fishing or boating trips.

It is a further object of this invention to provide a short haul tow which may be used with a standard square hitch receiver, which is commonly mounted on a recreational vehicle.

It is a further object of this invention to provide a short haul tow bar which is simple in construction and easily operated by a single person.

Other objects and advantages of this invention will become apparent from the description to follow, particularly when read in conjunction with the accompanying drawing.

SUMMARY OF THE INVENTION

The tow bar of this invention is particularly adapted for launching a boat which is temporarily supported at the stern by a pair of removable wheels. The tow bar is formed from a circular tube or pipe which is bent intermediate its ends to curve upward in a generally upright boat-attaching coupling section. The coupling itself is a helical coil around a vertical axis, which is welded to the top of a short steel coupling bar. Curling through more then 160°, the helical coupling may be turned through the eye commonly found at the bow of a boat and will provide a horizontal support surface through a wide angle. The upright trailing portion of the tow bar is flattened to provide a rectangular receptacle which receives the steel bar of the coupling. On the other end of the tow bar there is provided a short transverse sleeve which fits between two side walls of a hitch having aligned holes of approximately the internal diameter of the sleeve. A pin, which is inserted through the holes and sleeve and locked in place, completes the coupling.

DESCRIPTION OF A PREFERRED EMBODIMENT

Figures 1, 2, 3, 4:
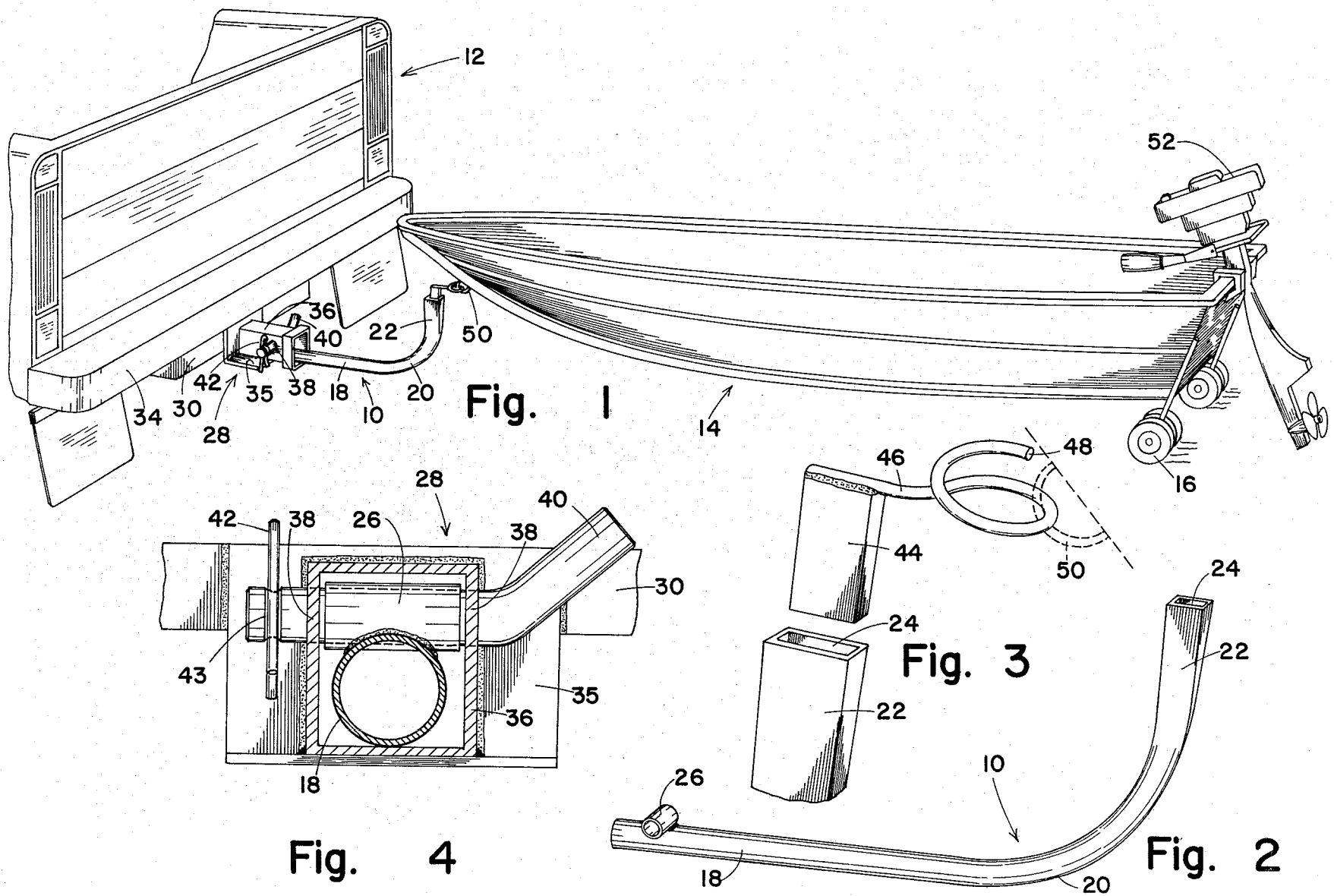
FIG. 1 is a view in perspective showing the tow bar of this invention in use.
FIG. 2 is an enlarged view in perspective of the tow bar.
FIG. 3 is an enlarged view in perspective of the upper end of the tow bar with the boat coupling.
FIG. 4 is an enlarged view in section of the vehicle-mounted hitch.

The short haul tow bar 10 of this invention is adapted to equip a motor vehicle 12 for pushing a small boat 14 which is temporarily supported at its stern by a pair of wheels 16, for the purpose of pushing the boat 14 from a location on shore, into the water for launching.

The tow bar 10 is formed from a cylindrical tube or pipe 18 which is bent intermediate its ends at 20 to curve upward, terminating in an upstanding portion 22, which is flattened at its end to form a rectangular receptacle 24. A transverse hinge sleeve 26 is welded across the generally horizontal pushing end of the tow bar 18.

The tow 10 thus far described is adapted to be used with a variety of hitches, including a square hitch receiver which is already mounted on many recreational vehicles, such as illustrated in FIGS. 1 and 4. The hitch 28 includes a mounting beam 30 adapted to be fixed to the frame of the vehicle 12, it being understood that the term "frame" in this context is broad enough to include the bumper 34. A box beam 36, which is welded to an angle 35 carried on the mounting beam 30, receives the transverse hinge sleeve 26 on the horizontal length 18 of the tow bar 10.

Aligned holes 38, which are of substantially the internal diameter of the hinge sleeve 26 are provided in the sides of the box beam 36 so that the hinge sleeve 26 may be aligned with them, and a hinge pin 40 inserted through to pivotally mount the tow bar 10 to the vehicle 12. A suitable cotter pin 42 may be inserted through a hole in, or a groove 43 around, the pin 40 to complete the vehicle coupling.

Referring now to FIG. 3, a boat coupling bar 44 has welded across the top thereof, a helical coupling hook 46 which is coiled from its end 48 through more than 360°. Hence, the hook 46 may simply be inserted through the eye 50 which is conventionally provided at the bow of the boat 14, and then the bow lifted to insert the coupling pin 44 into the receptacle 24, which is already in place. Such lifting takes relatively little effort because the boat is fulcrumed about the wheels 16 and any equipment, as well as an outboard motor 52 are at or near the stern of the boat 14.

The internal dimensions of the box beam 36 leave little clearance between it and the underside of the horizontal length 18 of the tow bar to limit downward pivotal movement. The upstanding portion 22 of the tow bar is of sufficient height, that when the coupling is completed by insertion of the coupling bar 44 into the receptacle 24, the boat 14 is supported above the ground. The hitch 36 is shown as being mounted on the rear bumper but it could just as well be mounted on the front bumper of the vehicle so that the vehicle may driven forwardly to push the boat 14. In any event, the vehicle may be driven from the campsite to push the boat down a ramp, if provided, and into the water. Then the bow of the boat 14 is lifted slightly to remove the coupling bar 44. The coupling bar may again be inserted into the receptacle 24 and the vehicle 12 driven back to the campsite. When the boat returns, it may simply be pulled to waters edge and the vehicle 12 brought back down to the waters edge. The coupling hook 46 is inserted the same way; the coupling bar is inserted into the receptacle 24; and the vehicle 12 driven back to the campsite. The outboard motor 52 may be left mounted and any equipment left aboard the boat 14 in full preparation for the next fishing or boating trip.

While this invention has been described in conjunction with the preferred embodiment thereof, it is obvious that modifications and changes therein may be made by those skilled in the art without departing from the spirit and scope of this invention, as defined by the claims appended hereto.

What is claimed as invention is:

1. A short haul tow bar for a motor vehicle on which is mounted a square hitch receiver comprising a rectangular tubular receptacle having aligned holes in the sides thereof and a retainer pin receivable in said aligned holes, for moving over a short distance a boat supported at one end by a pair of wheels, said tow bar comprising:

a tubular tow bar adapted at one end to be received in and to extend generally horizontally from, said square hitch receiver;

restraining means on said one end to receive a retainer pin extended through said aligned holes and prevent withdrawal of said one end from said hitch receiver;

vertical stop portions on said one end engageable with the top and bottom of said hitch receiver to restrict closely vertical oscillation of said bar;

lateral stop portions on said one end engageable with the sides of said hitch receiver to restrict closely horizontal oscillation of said bar;

said tow bar being bent intermediate its ends so that the other end thereof is generally upright; and a generally horizontal hook device carried on said other end and adapted to engage an eye on the other end of said boat.

2. The short haul tow bar defined by claim 1 wherein:

the other end of said bar forms an upstanding receptable; and including:

a complementary coupling bar receivable in said receptacle; said hook device being secured to said coupling bar.

3. The tow bar defined by claim 2 wherein:

said hook device is of helical configuration about a generally vertical axis so that it may be turned through said eye and provide a horizontal support surface over a wide angle.

4. The tow bar defined by claim 2 wherein:

said tow bar is of cylindrical tubular configuration at said one end but flattened at said other end to rectangular configuration.

5. The tow bar defined by claim 1 including:

a transverse hinge sleeve of a length to fit closely into said hitch receiver welded across said tow bar at one end to form said restraining means;

surfaces on said sleeve forming said lateral stop portions;

said retainer pin being closely receivable through said sleeve.

* * * * *